US008795780B2

(12) United States Patent
Jung

(10) Patent No.: US 8,795,780 B2
(45) Date of Patent: Aug. 5, 2014

(54) TEXTILE FABRIC SHEET HAVING STAIN AND LIQUID RESISTANCE AND THE PREPARATION METHOD THEREOF

(76) Inventor: Soon Kie Jung, Saddle River, NJ (US)

( * ) Notice: Subject to any disclaimer, the term of this patent is extended or adjusted under 35 U.S.C. 154(b) by 345 days.

(21) Appl. No.: 13/197,986

(22) Filed: Aug. 4, 2011

(65) Prior Publication Data

US 2013/0035011 A1 Feb. 7, 2013

(51) Int. Cl.
*B05D 3/12* (2006.01)
*B05D 3/02* (2006.01)

(52) U.S. Cl.
USPC ..... 427/356; 427/331; 427/358; 427/381

(58) Field of Classification Search
USPC ..... 442/71; 427/358, 381, 356, 331
See application file for complete search history.

(56) References Cited

U.S. PATENT DOCUMENTS 5,747,392 A * 5/1998 Xiao et al. ..... 442/82
2008/0124368 A1* 5/2008 Sarangapani ..... 424/405

* cited by examiner

*Primary Examiner* — Lynda Salvatore
(74) *Attorney, Agent, or Firm* — Sughrue Mion, PLLC

(57) ABSTRACT

Provided are a textile fabric sheet having stain and liquid resistance including a fabric sheet, a polyurethane coating layer formed on the fabric sheet and a silicon coating layer formed on the polyurethane coating layer and a method of preparing the same. Thus, a texture characteristic of the fabric substrate itself can be exhibited, and due to the polyurethane coating layer and the silicon coating layer stacked in two steps, excellent water resistance, stain resistance and air permeability can be exhibited.

3 Claims, 1 Drawing Sheet

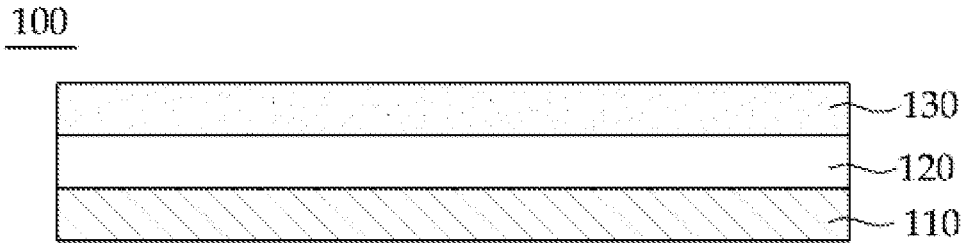
100
130
120
110

TEXTILE FABRIC SHEET HAVING STAIN AND LIQUID RESISTANCE AND THE PREPARATION METHOD THEREOF

TECHNICAL FIELD

This invention relates to a textile fabric sheet having stain and liquid resistance and a method of preparing the same, and more particularly, to a fabric sheet with excellent stain resistance, wear resistance as well as liquid barrier characteristics prepared by sequentially forming a polyurethane skin layer and a silicon coating layer on at least one surface of the fabric substrate and a method of preparing the same.

BACKGROUND

Generally, a textile fabric for interior application is being used for several years once installed. When they are contaminated by stains and spills, it is difficult to clean them every time, and these stains may leave bad marks on the surface, not good for aesthetics. Common stains include the ones caused by ball point pens, permanent marker, various liquids, solid or dust, impurities or other organic materials. Liquid stains or spills often seep through the open texture of the textile fabrics into the bottom cushion/foam underneath, and cause unsanitary environment in public places like hospitals, hotels, and restaurants.

To solve the above-mentioned issues, conventional stain resistant textiles are treated with stain resistant coating on the surface, and, if necessary, together with moisture barrier layer in the back of the fabric. However, when stain resistant coating is simply treated on the surface of the textile fabric, the effect is quite limited, not as good as other solid surface products, due to an open constructional characteristic of the textile fabric. Thus, it has been constantly required to develop a true stain resistant textile fabric that can be easily cleaned leaving no bad marks behind regardless of the type of stains.

SUMMARY

This invention has been made in an effort to provide a textile fabric sheet having an excellent stain, liquid and wear resistance, not sacrificing a true textile feel, which includes a skin layer—capable of providing a solid material base, on which stain resistance coating can be applied, acting as a liquid barrier with added wear resistance characteristics—and a coating layer on top having stain resistance and a method of preparing the same.

An exemplary embodiment of the present invention provides a textile fabric sheet having stain and liquid resistance, including: a fabric substrate; a polyurethane coating layer formed on the fabric substrate; and a silicon coating layer formed on the polyurethane coating layer.

The fabric substrate may be a woven or non-woven fabric composed of at least one selected from the group consisting of a polyester fiber, a viscose rayon fiber, a polyamide fiber, a polyurethane fiber, an acrylic fiber, a polyolefin fiber and a cellulose fiber.

The polyurethane coating layer may have a thickness of 1 to 200 μm, and the silicon coating layer may have a thickness of 1 to 30 μm.

A polyurethane resin used in the polyurethane coating layer may have an average molecular weight (Mw) of 10,000 to 700,000.

Another exemplary embodiment of the present invention provides a method of preparing a textile fabric sheet having stain and liquid resistance, including: (i) knife-coating a polyurethane coating composition at least once on one surface of a fabric substrate and drying the polyurethane coating composition; and (ii) coating a silicon coating composition on a surface of the coated polyurethane coating layer and drying the silicon coating composition.

In step (i), the fabric substrate may be knife-coated twice with the polyurethane coating composition. Here, a diameter angle of the knife may be 20 to 90 degrees.

The polyurethane coating composition may include a polyurethane resin at 10 to 100 g/m$^2$.

The silicon coating composition may include a mixture of (i) a silicon resin and (ii) at least one additive selected from the group consisting of a urethane resin, oil, platinum and fluorine. Here, the silicon coating composition may comprise a blend of the silicon resin and the additive in a weight ratio of 100:20-30.

According to the exemplary embodiments of the present invention, the textile fabric sheet having stain and liquid resistance can exhibit a texture characteristic of a fabric substrate itself and also exhibit water resistance, stain resistance and wear resistance due to a polyurethane coating layer and a silicon coating layer formed in two layers.

In addition, according to the exemplary embodiments of the present invention, when used as surface finishing materials of furniture or interior, the textile fabric sheet is less flawed due to good surface hardness, and is not easily stained by stains in everyday life, and the stains can be easily removed.

Moreover, according to the exemplary embodiments of the present invention, since the polyurethane coating layer prevents a liquid from permeating into the fabric sheet, unlike a conventional stain resistant product, a separate moisture barrier is not needed, which is more economical.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 1 is a cross-sectional view showing a configuration of a textile fabric sheet having stain and liquid resistance according to an exemplary embodiment of the present invention.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

The exemplary embodiments of the present invention will be described in detail with reference to the accompanying drawings.

Hereinafter, the expression "B formed above (or below) A" or "B formed on A" used herein includes all of cases when B is directly attached to a top or bottom surface of A, when B is attached to a top or bottom surface of A by means of an adhesive layer or pressure-sensitive adhesive layer, and when at least one separate layer is formed on a top or bottom surface of A and B is attached to the separate layer directly or by means of an adhesive layer or a pressure-sensitive adhesive layer, etc.

FIG. 1 is a cross-sectional view of a textile fabric sheet having stain and liquid resistance according to an exemplary embodiment of the present invention. Referring to FIG. 1, a textile fabric sheet having stain and liquid resistance 100 may sequentially comprise a fabric substrate 110 woven with fabric, and a polyurethane coating layer 120 and a silicon coating layer 130 formed on one surface of the fabric substrate 110.

A kind of the fabric substrate 110 used herein is not particularly limited, and thus a conventional woven or non-woven fabric known to those skilled in the art may be used.

The woven or non-woven fabric may be prepared with synthetic resin fibers such as a polyester fiber, a viscose rayon fiber, a polyamide fiber, a polyurethane fiber, an acrylic fiber, a polyolefin fiber and a cellulose fiber, alone or in combination; cotton (e.g., thread made of cotton); or a combination of the synthetic resin fiber and cotton. Among these, a woven fabric prepared with a mixture of the polyester fiber or the viscose rayon fiber, the polyamide fiber, the polyester fiber and the cotton, or the polyester fiber and the viscose rayon fiber is preferably used, but the present invention is not limited thereto. A polyester textile material is woven using a polyester fiber stretched to have very little or reduced elongation, and has high tension, low absorption and excellent drug resistance. In addition, an elastic fiber material such as spandex may be used.

A method of preparing woven or non-woven fabric using the above-mentioned material may be, but is not particularly limited to, a general paper-manufacturing or weaving process.

The fabric substrate 110 may have a thickness of 0.3 to 2 mm, but the present invention is not limited thereto.

The polyurethane coating layer 120 of the present invention may closely penetrate into the fabric substrate 110 while maintaining a web structure of the above mentioned fabric substrate 110 and may be thinly coated, thus exhibiting an original texture characteristic of the textile itself. In addition, the polyurethane coating layer 120 may prevent damage to the fabric substrate 110, and exhibit improved wear resistance and excellent water resistance because liquid does not permeate thereinto.

The polyurethane coating layer 120 may be formed using a conventional polyurethane resin known in the art. Non-limiting examples of the polyurethane resin may include polyether polyurethane, polyester polyurethane, polycarbonate polyurethane, polyetherester polyurethane, polyethercarbonate polyurethane, polycaprolactone polyurethane, hydrocarbon polyurethane, alicyclic polyurethane, aromatic polyurethane, or a combination of at least one thereof.

The polyurethane resin may have a weight average molecular weight (Mw) of 10000 to 700000, but the present invention is not limited thereto.

The polyurethane coating layer 120 may have a thickness of 1 to 200 μm. When the thickness of the polyurethane coating layer 120 is in the above-mentioned range, the polyurethane coating layer may exhibit an excellent coating effect, and have a fast drying speed and good workability.

The polyurethane coating layer 120 may be a transparent type or a colored type including a pigment. Generally, the fabric substrate 110 may have various colors and patterns, and thus a transparent polyurethane coating layer is preferably used to show such color and pattern as they appear originally. Here, a pigment may be any one known in the art, for example, a pigment containing an organic or inorganic component, without limitation.

The silicon coating layer 130 of the present invention may be formed on the polyurethane coating layer 120 and thus may exhibit excellent stain resistance.

The silicon coating layer 130 may be formed using a general silicon resin known in the art. The silicon resin may have an average viscosity of 1000 to 20000 cps, but the present invention is not limited thereto.

The silicon coating layer 130 may have a thickness of 1 to 30 μm. When the thickness of the silicon coating layer 130 is in the above-mentioned range, the silicon coating layer 130 may exhibit an excellent coating effect, and have a fast drying speed and good workability.

The textile fabric sheet having stain and liquid resistance according to the exemplary embodiment of the present invention may be prepared according to a method to be described below, but the present invention is not particularly limited thereto.

In the exemplary embodiment, the method may include (i) knife-coating a polyurethane coating composition at least once on one surface of a fabric substrate and drying the composition; and (ii) coating a silicon coating composition on a top surface of the coated polyurethane coating layer and drying the composition.

Knife coating is one of coating methods used when a fabric material is laminated. That is, a fabric substrate is provided on a revolving roller to move, a liquid coating composition is provided on the moving fabric substrate, and the provided liquid coating composition passes through a knife extending in a width direction and formed on the roller. Here, the thickness of the coating layer is determined according to a height of the knife.

Meanwhile, when the polyurethane coating layer is very thick, the final textile fabric sheet becomes rigid, and thus is deteriorated in texture as textiles. Thus, in the present invention, a polyurethane coating composition and a silicon coating composition are sequentially coated on a fabric substrate using knife coating. Here, the coating composition may be thinly coated at least twice to maintain air permeability of the fabric substrate and soft texture.

In the exemplary embodiment, each of the polyurethane coating composition and the silicon coating composition may be knife-coated once or at least twice. The polyurethane coating composition is preferably knife-coated at least twice. Here, a diameter angle of the knife, a thickness of the knife and a viscosity of the coating composition may be appropriately controlled in consideration of texture, wear resistance and stain resistance of the final fabric sheet of the present invention.

During the knife coating, the diameter angle of the knife may be 20 to 90 degrees. Generally, as the knife angle is decreased and the knife thickness is increased, a coating layer to be formed has a larger thickness. Considering this, when the coating composition is coated at least twice, the diameter angle of the knife in the first coating step may be larger than the diameter angle of the knife in the second coating step, and thus the coating composition may be thinly coated. Actually, the thickness of the coating layer to be formed may be controlled by adjusting the viscosity of the coating composition, the knife angle or the knife thickness, and thus a polyurethane resin or silicon resin may be thinly and uniformly applied to a surface of the fabric substrate to have a predetermined thickness. In addition, an applying amount of the coating composition may be reduced, and excellent adhesive strength may be ensured.

The polyurethane coating composition according to the exemplary embodiment of the present invention may be a liquid resin composition including a urethane resin selected according to a material of the substrate, a curing agent and an organic solvent. As an example, the urethane resin and the curing agent are dispersed in the organic solvent and diluted at an appropriate concentration, thereby preparing the polyurethane coating composition.

The curing agent and the organic solvent may be any of conventional ones known in the art without limitation. Non-liming examples of the solvent which can be used herein may be a ketone-based solvent such as methylethylketone (MEK), methylisobutylketone (MIBK) or acetone; an alcohol-based solvent such as isopropylalcohol (IPA) or n-hexanol; or 1,2-dichlorobenzen, N-methylpyrrolidone (NMP) or N,N-dimethylformamide (DMF). When necessary, the polyurethane coating composition may further include a reinforcing filling agent or weight filling agent, for example, colloidal silica, fumed silica; a coloring agent and a pigment; a thermal stabilizer, a UV stabilizer and a weather stabilizer; a flame retardant, a thickening agent, an herbicide or a preservative.

The viscosity of the polyurethane coating composition to use the knife coating method may be 1000 to 20000 cps, but the present invention is not particularly limited thereto. Here, the polyurethane coating composition may contain a polyurethane resin at 10 to 100 g/m$^2$.

The polyurethane coating layer formed as described above is exposed to air for sufficient time, thereby forming a cured film. Here, drying time and conditions may be adjusted within a conventional range. For example, the drying may be performed at room temperature or approximately 80 to 250° C. for 1 to 24 hours.

A silicon coating composition is knife-coated on the formed polyurethane coating layer, and then dried.

A silicon resin generally has a very high viscosity, and thus is not suitable for knife coating and does not easily form a uniform coating layer even if coated. For these reasons, in the present invention, an additive capable of reducing the viscosity of the silicon resin is used as a component of the silicon coating composition.

The silicon coating composition according to the exemplary embodiment of the present invention may be a combination of (i) a silicon resin and (ii) at least one additive selected from the group consisting of a urethane resin, oil, platinum and fluorine.

The silicon resin may be a conventional one known in the art without limitation. The silicon coating composition may include a blend of the silicon resin and the additive in a weight ratio of 100:20-30. The uniformly mixed silicon coating composition may have a viscosity of 200 to 10,000 cps.

In the formation of the silicon coating layer, knife coating, coating conditions and drying conditions may be the same as those used in the formation of the polyurethane coating layer described above. Here, when the silicon coating layer is coated at least twice, a solid content of the silicon coating composition in the second coating step may be lower than that in the first coating step.

The textile fabric sheet according to the exemplary embodiment of the present invention prepared as described above may have a structure in which the web structure of the fabric substrate woven with a fiber is preserved, and the reduction in air permeability of the final textile fabric sheet according to the introduction of the coating layer may be minimized.

Meanwhile, in the present invention, the polyurethane coating layer 120 and the silicon coating layer 130 are sequentially formed on the fabric substrate 110. However, the number and stacking sequence of coating layers constituting the textile fabric sheet having stain and liquid resistance may be freely selected according to a purpose, which is also included in the scope of the present invention.

As an example, a multi-layered structure having at least three layers may be formed by changing the sequence of the coating layers 120 and 130 or introducing a different surface layer. Here, a detachable film may be formed on the other surface of the fabric substrate 110, and further include a surface layer on a top surface of the silicon coating layer. Like this, as the detachable film and surface layer are additionally formed, shape stability of the textile fabric sheet having stain and liquid resistance may be ensured, and surface damage due to friction may be prevented.

The textile fabric sheet having stain and liquid resistance according to the exemplary embodiment of the present invention may be applied to various interior or exterior products. The interior products can be applied to all products to which the textile fabric sheet having stain and liquid resistance will be introduced, and unlimited examples thereof may include wall paper, furniture, flooring materials, interior materials, exterior materials, surface materials, wood or interior accessories.

Hereinafter, the present invention will be described in detail with reference to Examples. However, these Examples are merely provided to describe the present invention, not to limit the scope of the present invention.

Example 1

Preparation of Textile Fabric Sheet Having Stain and Liquid Resistance

A polyurethane coating composition (viscosity: 5000-7000 cps) including a polyurethane resin having a molecular weight of 20000 to 200000 and a solvent mixture of MEK, EA and TO was first knife-coated on a polyester fabric. Here, a knife angle was 30 to 60 degrees, drying was performed at 100° C. for 1 to 5 minutes, and second knife coating was performed, thereby forming a final polyurethane coating layer having a thickness of 10 to 100 μm. A silicon coating composition in which a silicon resin and platinum were mixed in a weight ratio of 100:30 was knife-coated on the coated polyurethane, and dried at 100 to 220° C. for 10 to 24 hours, thereby preparing a textile fabric sheet having stain and liquid resistance (ZENUS-GRAFFITI-FREE FABRIC®).

Experimental Example 1

Evaluation of Physical Property of Textile Fabric Sheet Having Stain and Liquid Resistance 1) Evaluation of Stain Resistance Evaluation of stain resistance was performed using the textile fabric sheet having stain and liquid resistance prepared in Example 1.

The evaluation method was repeatedly performed 50 times using the same stains to evaluate a degree of staining by eyes. Here, as the stains, an oil-based ballpoint pen and a permanent marker, stains from which are the most difficult to prevent, were used. In addition, as a control group, a fabric sheet 1 (pattern: Space pod, color: Havana) and a fabric sheet 2 (pattern: Teleport stripe, color: Retro) currently produced by Crypton were used.

As a result, the ballpoint pen did not stain a surface of the fabric sheet of Example 1, and the permanent marker left a blurry mark that was easily removed by a cloth permeated with alcohol.

On the other hand, on the fabric sheet of the control group, the ballpoint pen and the permanent marker left marks easily, which were impossible to remove with the cloth permeated with alcohol. Therefore, it can be noted that the fabric sheet of the present invention had a more excellent stain resistant effect than the control group.

2) Evaluation of Wear Resistance (Friction Fastness)

The textile fabric sheet having stain and liquid resistance of Example 1 was tested according to an ASTM D4157 Wyzenbeek method. Here, as a control group, fabric sheets 1 and 2 produced by Crypton used in the Evaluation of Stain Resistance were used.

Generally, when a result of the wear resistance test was 30000 rubs or more, it was indicated as heavy duty, and when a result of the wear resistance test was more than 50000 rubs, it is determined as commercially suitable.

The results of the test were that the fabric sheet produced by Crypton withstood 80000 rubs (1) and 50000 rubs (2), respectively, and the textile fabric sheet having stain and liquid resistance of the present invention withstood more than 200000 rubs. It can be confirmed that, regardless of abrasion of the textile, due to the polyurethane coating layer formed on its surface, the wear resistant effect was drastically improved.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A method of preparing a textile fabric sheet having stain and liquid resistance, said textile fabric sheet comprising a fabric substrate; a polyurethane coating layer; and a silicon coating layer in this order, said method comprising:

(i) providing the fabric structure;

(ii) knife-coating a polyurethane coating composition at least once on one surface of the fabric substrate, drying the polyurethane coating composition, and forming the polyurethane coating layer having thickness of 1 to 200 μm on the one surface of the fabric substrate; and (iii) coating a silicon coating composition on the polyurethane coating layer and drying the silicon coating composition to form the silicon coating layer of a thickness of 1 to 30 μm to give the textile fabric sheet comprised of the fabric substrate, polyurethane coating layer and the silicon coating layer, in this order;

wherein in step (i), the fabric substrate is knife-coated twice with the polyurethane coating composition; and during knife coating, a diameter angle of the knife is 20 to 90 degrees; and wherein the polyurethane coating composition includes a polyurethane resin at 10 to 100 $g/m^2$, a curing agent and an organic solvent.

2. The method of claim 1, wherein the silicon coating composition includes a mixture of (i) a silicon resin; and (ii) at least one additive selected from the group consisting of a urethane resin, oil, platinum and fluorine.

3. The method of claim 2, wherein the silicon resin and the additive are used in a weight ratio of 100:20-30.

* * * * *